US007669505B2

(12) United States Patent
Campbell et al.

(10) Patent No.: US 7,669,505 B2
(45) Date of Patent: Mar. 2, 2010

(54) PIN LOCK PLIERS

(75) Inventors: David C. Campbell, Bel Air, MD (US); Robert H. Gifford, New Freedom, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/127,425

(22) Filed: May 27, 2008

(65) Prior Publication Data

US 2009/0293685 A1 Dec. 3, 2009

(51) Int. Cl.
*B25B 7/14* (2006.01)
*B25B 7/10* (2006.01)
*B25B 7/04* (2006.01)

(52) U.S. Cl. ..... 81/409; 81/331; 81/367

(58) Field of Classification Search ..... 81/315, 81/318–333, 337, 339, 342–346, 355–357, 81/363, 367–384, 405, 409, 409.5, 413
See application file for complete search history.

(56) References Cited

U.S. PATENT DOCUMENTS

| | | | | | |
|---|---|---|---|---|---|
| 1,879,452 | A | * | 9/1932 | Palotce | 81/319 |
| 2,532,141 | A | * | 11/1950 | Barkan et al. | 29/229 |
| 3,283,404 | A | * | 11/1966 | Hickman | 30/91.2 |
| 4,893,530 | A | | 1/1990 | Warheit | |
| 4,896,661 | A | * | 1/1990 | Bogert et al. | 606/86 R |
| 5,033,338 | A | * | 7/1991 | Ford, Jr. | 81/318 |
| 5,060,543 | A | | 10/1991 | Warheit | |
| 5,385,072 | A | | 1/1995 | Neff | |
| 5,469,765 | A | * | 11/1995 | Franklin | 81/324 |
| 5,970,827 | A | * | 10/1999 | Lin | 81/409 |
| 6,014,917 | A | | 1/2000 | Bally et al. | |
| 6,065,376 | A | | 5/2000 | Khachatoorian | |
| 6,116,124 | A | | 9/2000 | Ping | |
| 6,161,455 | A | | 12/2000 | Ping | |
| 6,178,855 | B1 | | 1/2001 | Bally et al. | |
| 6,199,458 | B1 | | 3/2001 | Wrigley et al. | |
| 6,450,555 | B1 | * | 9/2002 | Collister et al. | 292/210 |
| 6,508,149 | B1 | * | 1/2003 | Heggemann et al. | 81/320 |
| 6,658,971 | B2 | * | 12/2003 | Delbrugge et al. | 81/405 |
| 6,662,690 | B1 | * | 12/2003 | Ploeger | 81/318 |
| 6,711,789 | B2 | * | 3/2004 | Ping | 24/505 |
| 6,745,441 | B1 | * | 6/2004 | Lin | 24/505 |
| 6,860,179 | B2 | * | 3/2005 | Hopper et al. | 81/318 |
| 7,007,936 | B2 | * | 3/2006 | Chang | 269/6 |
| 7,044,032 | B2 | | 5/2006 | Janson | |
| 7,107,881 | B1 | * | 9/2006 | Liou | 81/318 |
| 7,117,771 | B2 | | 10/2006 | Whiteford | |
| 7,146,887 | B2 | * | 12/2006 | Hunter | 81/367 |
| 7,299,724 | B1 | | 11/2007 | Warheit | |
| 2006/0272458 | A1 | * | 12/2006 | Kelly | 81/367 |
| 2008/0066588 | A1 | * | 3/2008 | Yang | 81/318 |

* cited by examiner

*Primary Examiner*—David B Thomas
(74) *Attorney, Agent, or Firm*—Harness, Dickey & Pierce, P.L.C.

(57) ABSTRACT

A hand tool for gripping a workpiece can include a first lever having a first handle and a first jaw and a second lever having a second handle and a second jaw. A locking assembly can include a pivoting lever, a locking pin and a blocking member. The pivoting lever can be pivotally coupled to the second lever. The blocking member can be coupled to the first lever. The pivoting lever can be movable between an unlocked position, wherein the first and second jaw move relative to each other and a locked position, wherein the first and second jaws are fixed relative to each other. In the locked position, the locking pin can be wedged against a contact surface of the blocking member precluding relative motion of the blocking member and the pivoting lever.

21 Claims, 5 Drawing Sheets

PIN LOCK PLIERS

FIELD

The present disclosure relates to a hand tool that is used to grip a workpiece and more particularly to a hand tool having a locking assembly for locking first and second jaw members of the hand tool from relative movement.

BACKGROUND

The statements in this section merely provide background information related to the present disclosure and may not constitute prior art.

Hand tools, such as pliers, can be used to grip a workpiece and provide a compression force onto the workpiece. In general, pliers can comprise opposing jaw members that are associated with respective handles. In one method of use, the handles can be squeezed together causing the jaw members to ultimately compress towards each other. In some instances, it may be desired to maintain such a gripping action onto the workpiece without requiring a user to maintain a constant gripping action onto the handles with the user's hand.

Some pliers are equipped with locking mechanisms that can maintain a gripping force onto a workpiece after a user has withdrawn a hand gripping action from the handles. Such locking mechanisms, however, can be difficult to manipulate. Furthermore, some pliers are provided with locking mechanisms that do not allow a user to have good hand control of the tool while transitioning from a first position of compressing the handles of the pliers to a second position of additionally engaging the locking function.

SUMMARY

A hand tool for gripping a workpiece can include a first lever having a first handle and a first jaw and a second lever having a second handle and a second jaw. A locking assembly can include a pivoting lever, a locking pin and a blocking member. The pivoting lever can be pivotally coupled to the second lever. The blocking member can be coupled to the first lever. The pivoting lever can be movable between an unlocked position, wherein the first and second jaw move relative to each other and a locked position, wherein the first and second jaws are fixed relative to each other. In the locked position, the locking pin can be wedged against a contact surface of the blocking member precluding relative motion of the blocking member and the pivoting lever.

According to additional features, the contact surface can be planar along a length of the blocking member. The locking pin can be operable to wedge against the contact surface at any location along the contact surface. The locking assembly can further comprise a barrel rotatably received in a boss defined in the second lever. The locking pin can be removably received in a slot defined in the barrel. In the locked position, the locking pin can wedge between the contact surface of the blocking member and a surface of the slot.

According to still other features, the barrel can define an aperture that slidably receives the blocking member. The aperture can extend through a diameter of the barrel. The slot can extend between an outer diametrical surface of the barrel and the aperture. The slot can define a longitudinal axis that is offset from a center of the barrel. A biasing member can bias the pivoting lever toward the unlocked position.

According to other features, the pivoting lever can include first and second user engagement portions defined by respective first and second extension portions formed thereon.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
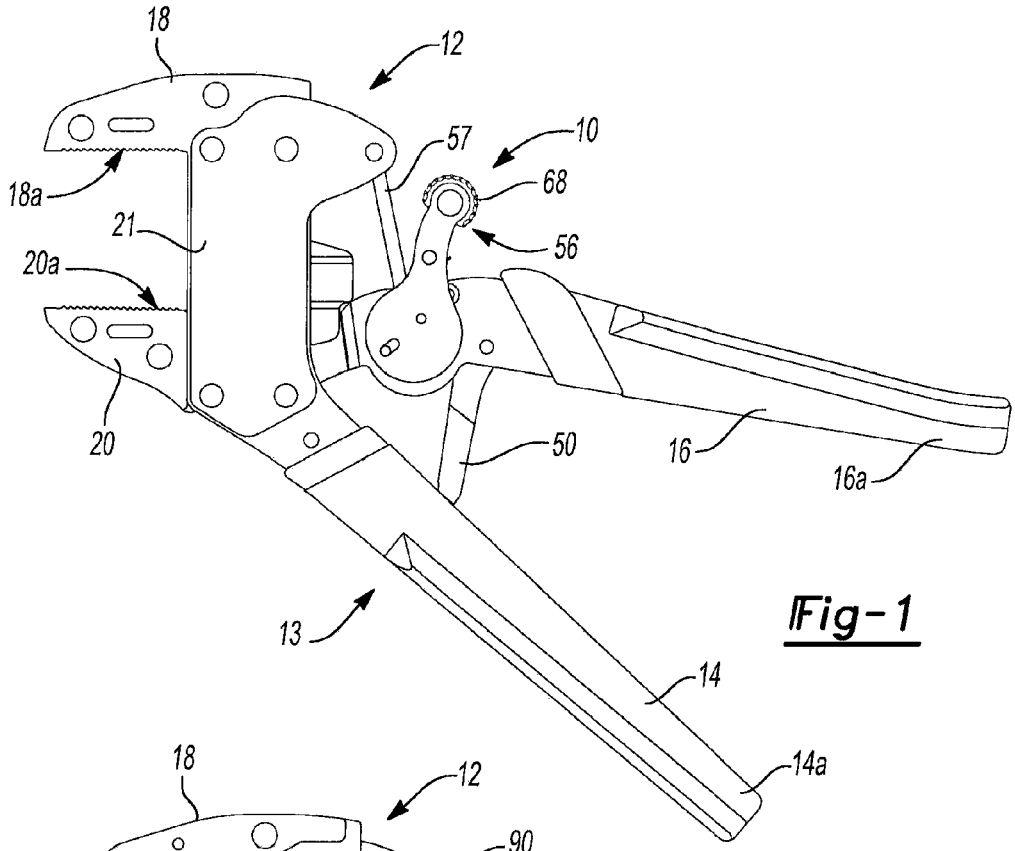
FIG. 1 is a side elevational view of exemplary pliers having a locking assembly constructed in accordance to one example of the present disclosure.

The following description is merely exemplary in nature and is not intended to limit the present disclosure, application, or uses. It should be understood that throughout the drawings, corresponding reference numerals indicate like or corresponding parts and features.

Figure 2:
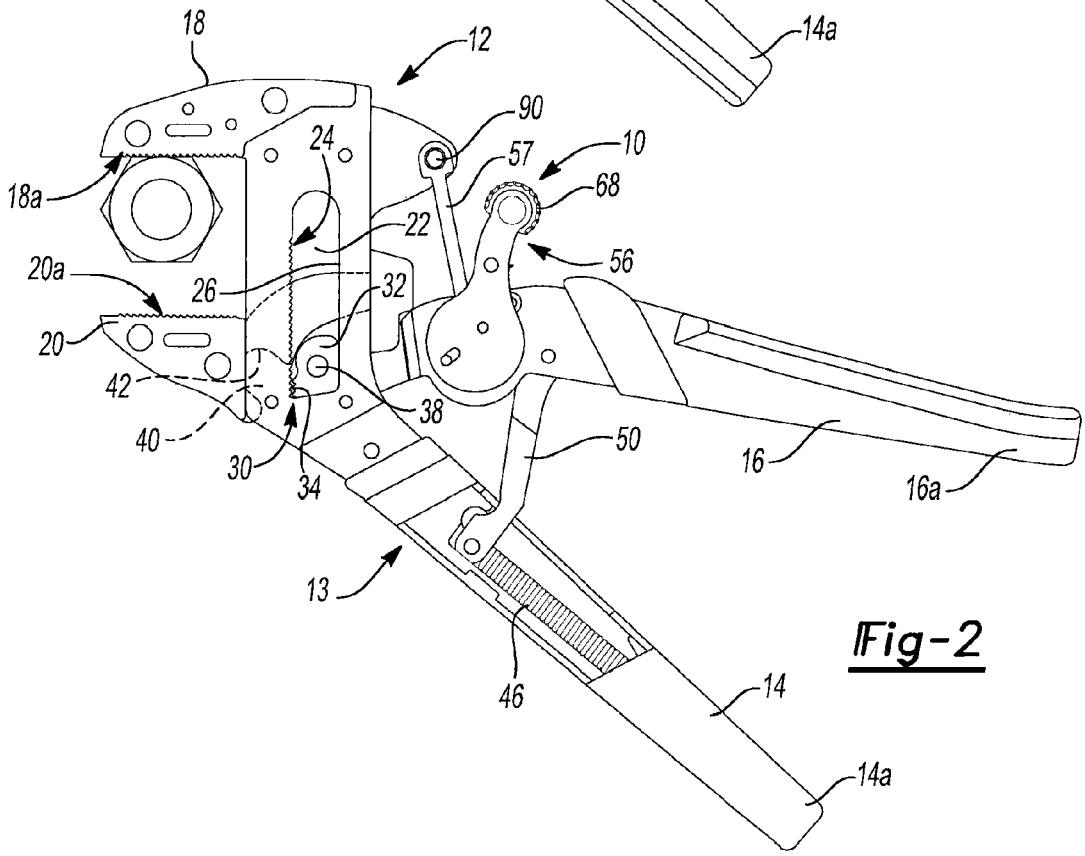
FIG. 2 is a side elevational view of the exemplary pliers of FIG. 1 and shown with a cover portion removed to illustrate a locking pawl assembly.
Figure 7:
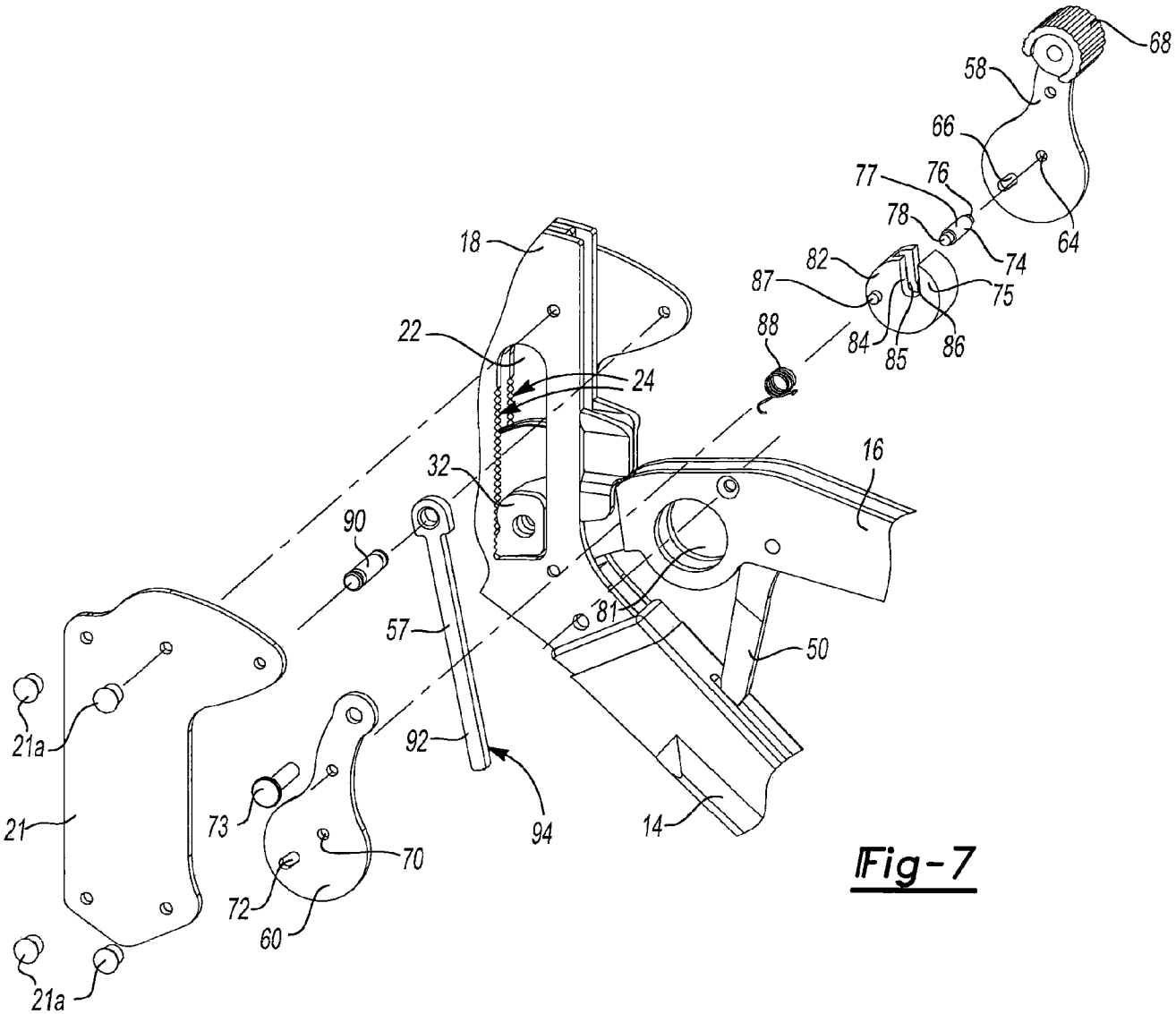
FIG. 7 is a partial exploded view of the pliers and locking assembly of FIG. 1.

With initial reference to FIGS. 1 and 2, a locking assembly 10, constructed in accordance with the present teachings is shown operatively associated with an exemplary pair of pliers 12. The pair of pliers 12 generally comprises a pliers portion 13 and the locking assembly 10. While the focus of this disclosure is directed toward the locking assembly 10, a brief description of the pliers portion 13 of the exemplary pliers 12 will first be provided. The pliers portion 13 can include a first lever 14, a second lever 16, a fixed jaw 18, and a sliding jaw 20. The fixed jaw 18 can be fixedly coupled to the first lever 14. The sliding jaw 20 can be mounted on the second lever 16. The first lever 14 can have a handle 14*a*. The second lever 16 can have a handle 16*a*. The first and second levers 14, 16 can criss-cross one another, such that the fixed jaw 18 is disposed opposite from a sliding jaw 20. The fixed jaw 18 can define a jaw surface 18*a*. The sliding jaw 20 can define a jaw surface 20*a*. A cover plate 21 can be secured to the fixed jaw 18 by way of fasteners 21*a* (FIG. 7).

As shown in FIG. 2, the first lever 14 can define a slot 22 having slot teeth 24 formed on one side and a smooth surface 26 formed on an opposite side. In one example, the slot 22 can be formed generally transverse to the jaw surfaces 18*a* and 20*a*. The second lever 16 can include a pawl assembly 30 that includes a pair of offset pawls 32 (only one specifically shown) each having pawl teeth 34 formed on a first side and a smooth rear face 36 (FIG. 4) formed on a second side. The pawl assembly 30 can be pivotally connected to the second lever 16 by a pin 38 (FIG. 2). The second lever 16 can further define a nose 40 that selectively engages an angled slot 42 defined by the sliding jaw 20 (see FIG. 4).

Figure 4:
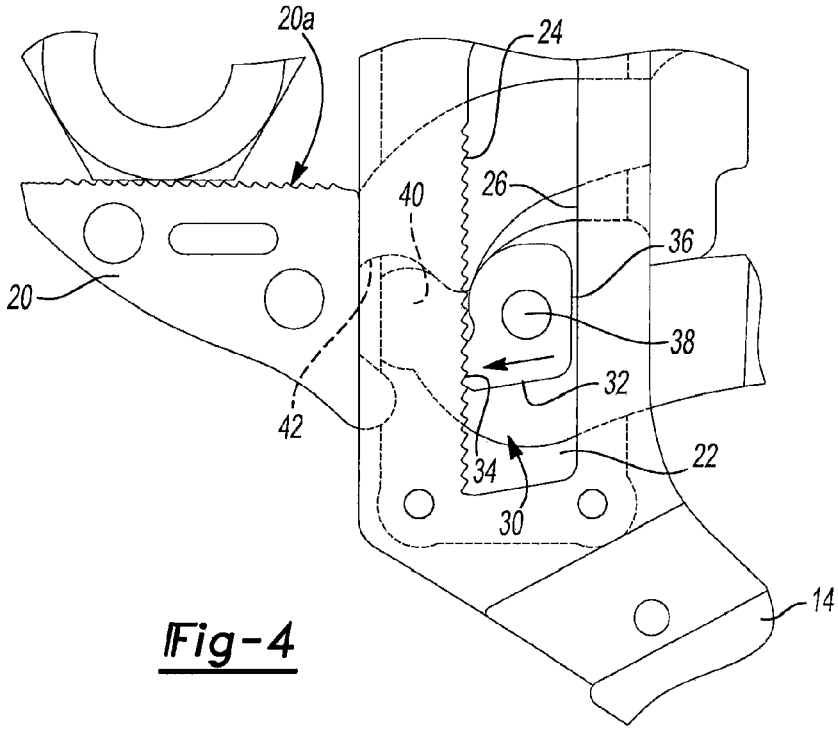
FIG. 4 is an enlarged detailed view of a portion of the pliers of FIG. 2.

The pawls 32 can have a width that is slightly less than a width of the slot 22 that permits the pawls 32 to be moved along the length of the slot 22. During a clamping motion in which the first and second levers 14 and 16 are urged together, the pawl teeth 34 engage the slot teeth 24 while the nose 40 nests within the angled slot 42 as shown in FIG. 4. During a release motion in which the first and second levers 14 and 16 are moved away from each other, the rear face 36 of the pawls 32 can slide along the smooth surface 26 of the slot 22 as shown in FIG. 2.

Figure 3:
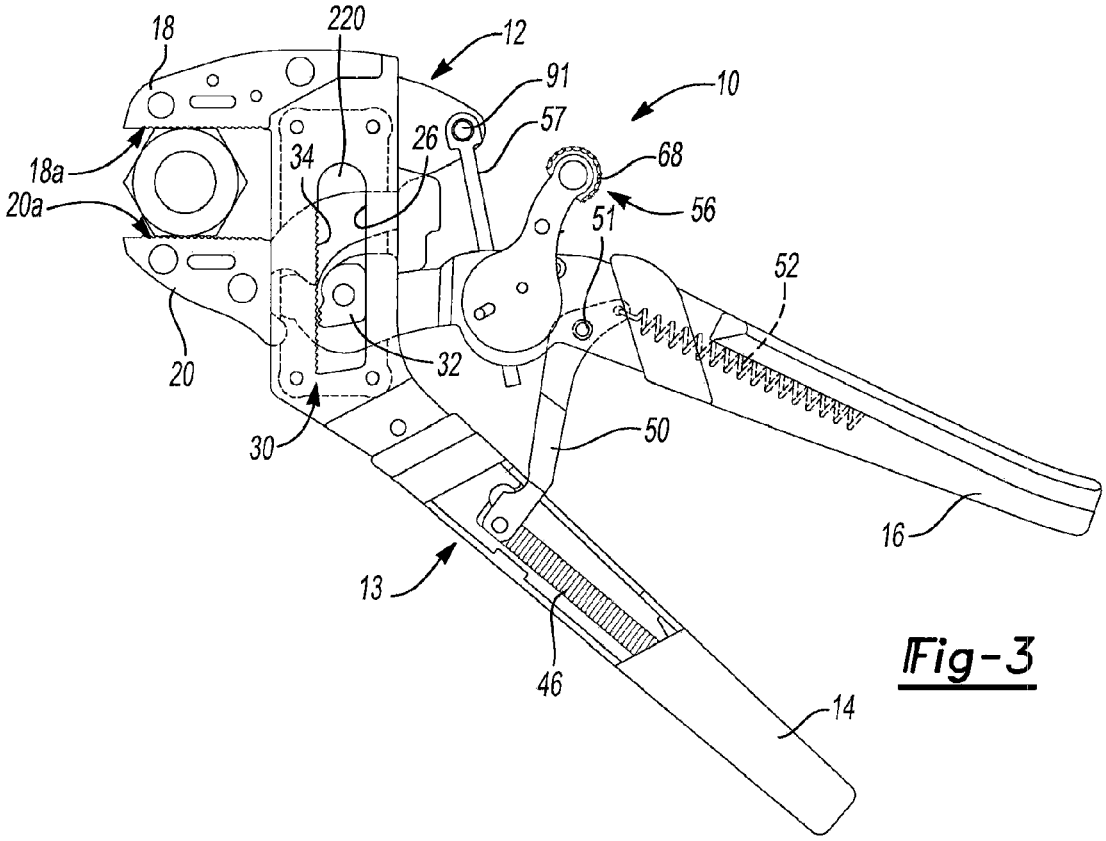
FIG. 3 is a side elevational view of the exemplary pliers illustrated in FIG. 2 and shown with respective jaws engaged to a workpiece.

With reference to FIGS. 2 and 3, a first biasing member 46 can be disposed in the first lever 14 and coupled at one end to a lever arm 50. The lever arm 50 can be pivotably coupled to the second lever 16 by a rivet 51. A second biasing member 52 can be disposed in the second lever 16 and coupled at an opposite end to the lever arm 50. The lever arm 50 and the biasing members 46 and 52 can cooperate to bias the fixed jaw 18 and the sliding jaw 20 apart when there is no load applied to the pliers 12 by a user (i.e., no load applied to the first and second levers 14 and 16). The lever 50 and the biasing members 46 and 52 can also cooperate to transfer the force applied by a user from the first and second levers 14 and 16 to the fixed jaw 18 and sliding jaw 20, respectively, upon engagement of the pawl teeth 34 of the pawl 32 with the slot teeth 24 of the slot 22.

Because the pawl assembly 30 is pivotally connected to the second lever 16, the movement of the first lever 14 can cause the pawl assembly 30 to be moved from the smooth surface 26 to the slot teeth 24. The pawl teeth 34 of the pawl assembly 30 engage the slot teeth 24. When this engagement occurs, the active fulcrum of the pliers 12 can be transferred from the rivet 51 of the lever 50 to the pin 38, which connects the pawl assembly 30 to the second lever 16. Additional details on the construction and operation of the exemplary pliers portion 13 of the pliers 12 can be found in U.S. Pat. No. 7,299,724 to Warheit, which is expressly incorporated by reference herein. Those skilled in the art will appreciate that the specific configuration of the pliers portion 13 is merely exemplary and the locking assembly 10 can be incorporated on other tools having first and second jaw members.

Figure 5:
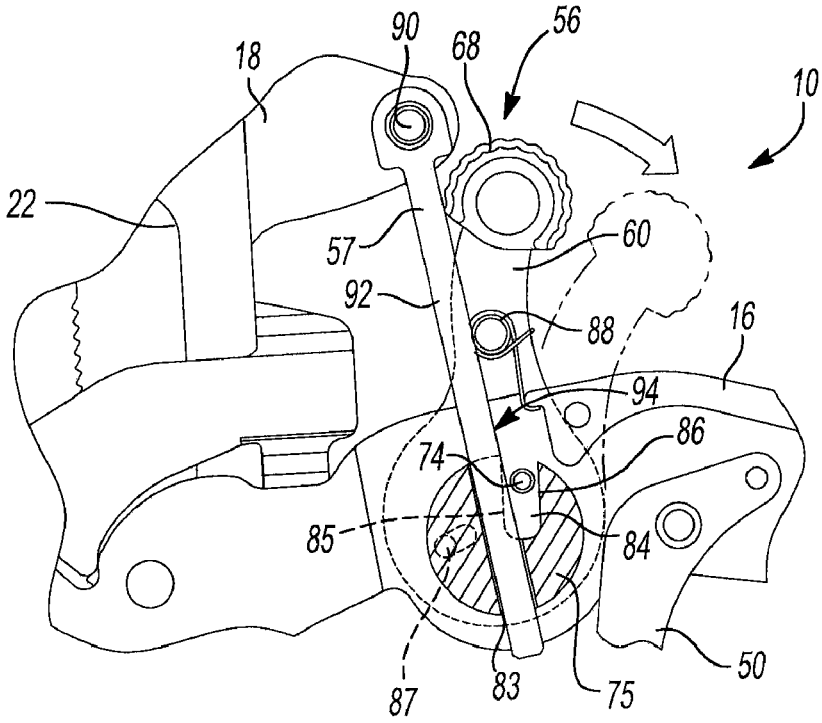
FIG. 5 is an enlarged detailed view of the locking assembly according to one example of the present disclosure and shown in an unlocked position.
Figure 6:
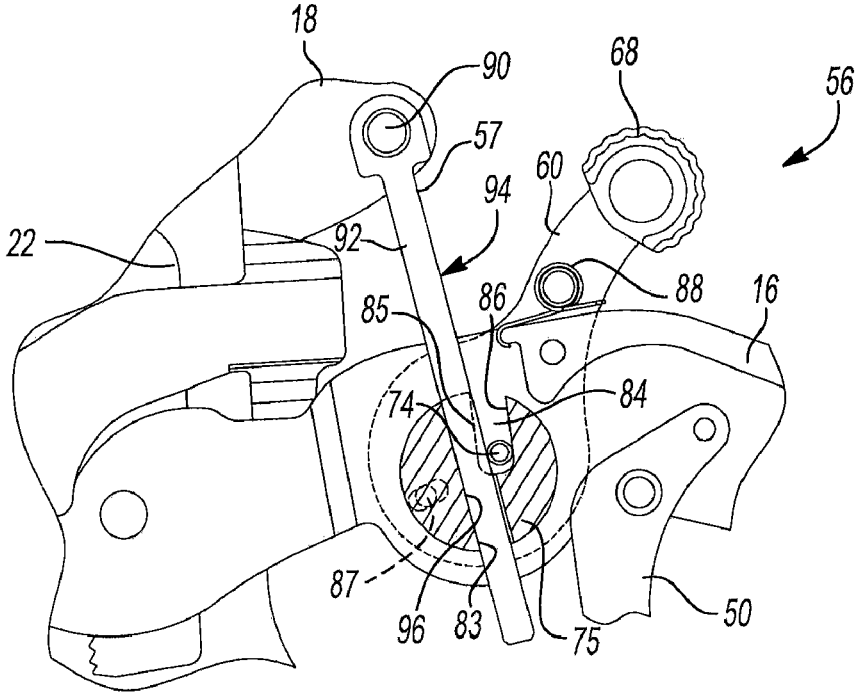
FIG. 6 is an enlarged detailed view of the exemplary locking assembly of FIG. 5 and shown with a pivoting lever rotated to a locked position.

With reference now to FIGS. 5-7, the locking assembly 10 will now be described. The locking assembly 10 can include a pivoting lever assembly 56 and an engagement member, a blocking member or a blocking rod 57. The pivoting lever assembly 56 can have a first pivoting lever 58 (FIG. 7) and a second pivoting lever 60. The first pivoting lever 58 can define a first pin mount 64, a first slot 66 and a thumb contact portion 68. The second pivoting lever 60 can include a second pin mount 70 and a second slot 72. The first and second pivoting levers 58 and 60 can be coupled relative to each other by a fastener 73. In one example, the thumb contact portion 68 can be formed of resilient material to facilitate a gripping action thereon.

The pivoting lever assembly 56 can also comprise a locking pin 74 and a locking barrel 75. The locking pin 74 can have a first end 76, a main body 77, and a second end 78. The first end 76 can be fixed in the first pin mount 64 of the first pivoting lever 58. The second end 78 can be fixed in the second pin mount 70 of the second pivoting lever 60. In one example, the first and second ends 76 and 78 can define a reduced diameter compared to the main body 77.

The locking barrel 75 can be rotatably received in a boss 81 defined in the second lever 16. In one example, the locking barrel 75 can generally define a cylindrical body 82. The locking barrel 75 can include a rod aperture 83 (FIGS. 5 and 6) and a lock slot 84. The rod aperture 83 can extend through the diameter of the locking barrel 75 and be sized to slidably receive the blocking rod 57. The lock slot 84 can extend between the outer diametrical surface of the locking barrel 75 and the rod aperture 83. The lock slot 84 can define a forward surface 85 and a first wedge surface or rearward surface 86. Unlike the rod aperture 83, the lock slot 84 can be offset so that its longitudinal axis does not intersect the center of the locking barrel 75. The locking pin 74 can be received in the lock slot 84. The locking barrel 75 can define a pair of oppositely extending nubs 87 (only one specifically shown). The nubs 87 can be received by the first and second slots 66 and 72 defined in the respective first and second pivoting levers 58 and 60. A biasing member 88 can be coupled to the second lever 16 and the pivoting lever assembly 56 to bias the pivoting lever assembly 56 into the position shown in FIG. 5 (unlocked position).

The blocking rod 57 can be pivotally coupled to the fixed jaw 18 by way of a pin 90. The blocking rod 57 can define a body portion 92 that is generally of uniform cross-section along a length thereof. In one example, the blocking rod 57 can define a rectangular cross-section. Other shapes and configurations are contemplated. The blocking rod 57 can define a smooth (i.e., planar) contact surface 94. In one example, the blocking rod 57 can define a cross-section that is slightly less than a cross-section defined by the rod aperture 83. In this way, the blocking rod 57 is free to slidably translate through the rod aperture 83 of the locking barrel 75 in the unlocked position.

The pivoting lever assembly 56 is movable between an unlocked position (FIG. 5) and a locked position (FIG. 6). In the unlocked position, the pivoting lever assembly 56 can be generally in an upright position. In the unlocked position, the locking pin 74 is slidably received in the lock slot 84 to permit relative movement between the first and second levers 14, 16 (i.e., so that the sliding jaw 20 may be moved relative to the fixed jaw 18). In the locked position, the pivoting lever assembly 56 can be rotated clockwise to a position as viewed in FIG. 6. According to one example, the pivoting lever assembly 56 can be rotated to the locked position by moving a user's thumb onto the thumb contact portion 68 and moving the thumb contact portion 68 toward the second lever 16 in a direction generally toward a user's wrist. As such, the remainder of a user's hand can remain engaged with the first and second levers 14 and 16 to provide compression. The user is afforded significant control of the pliers 12 as a whole while manipulating the pivoting lever assembly 56. In the locked position, the locking pin 74 can be wedged against the rearward surface 86 of the lock slot 84 and the contact surface 94 of the blocking rod 57. In one example, the rearward surface 86 of the lock slot 84 and the contact surface 94 of the blocking rod 57 can define planes that intersect. The wedging action on the locking pin 74 traps the blocking rod 57 against a surface 96 of the rod aperture 83 and against the body 77 of the locking pin 74. As a result, the blocking rod 57 is precluded from slidably advancing through the rod aperture 83.

In the locked position, the blocking rod 57 fixes the fixed jaw 18 relative to the second lever 16. The fixed jaw 18 and the sliding jaw 20 are therefore maintained in a static position. Of note, because the contact surface 94 of the blocking rod 57 is planar, the locking pin 74 is operable to engage and therefore be wedged against any portion along the length of the blocking rod 57. Such a configuration can be advantageous in that the locking pin 74 is not limited to a predetermined amount of suitable locking locations relative to the blocking rod 57.

To release the pivoting lever assembly 56, a user can rotate the thumb contact 68 in a generally counter-clockwise direction as viewed in FIG. 6, or alternatively, squeeze the first and second levers 14 and 16 together, which will allow the biasing member 88 to urge the pivoting lever assembly 56 back toward the position shown in FIG. 5.

Figure 8:
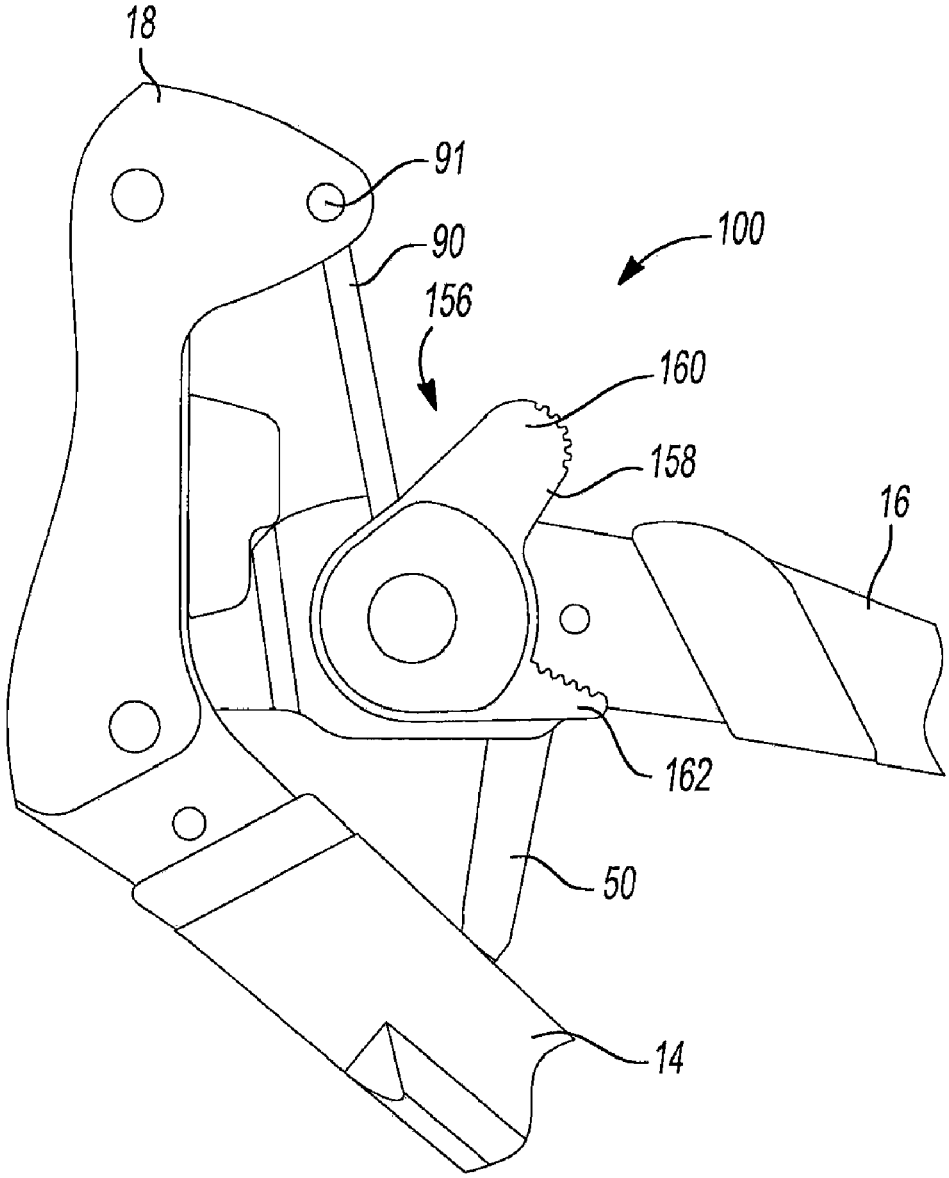
FIG. 8 is a side view of a locking assembly constructed in accordance to another example of the present teachings.

Turning now to FIG. 8, a locking assembly 100 constructed in accordance to additional features of the present disclosure is shown. The locking assembly 100 can generally comprise a pivoting lever assembly 156. The pivoting lever assembly 156 can define a pivoting lever 158 having first and second extension portions 160 and 162 formed thereon. The extension portions 160 and 162 can be in the form of protruding arms that provide a user multiple user engagement portions for imparting a rotational motion onto the pivoting lever 158. As can be appreciated, in some instances it may be easier for a user to engage one of the extension portions 160 or 162 over the other extension portion 160 or 162. In the example shown, the extension portions 160 and 162 extend approximately 45° relative to each other. Other arrangements are contemplated. For example, a pivoting lever may have three, four, five, or more extension portions formed therearound for a user to engage.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A hand tool for gripping a workpiece comprising:

a first lever having a first handle and a first jaw;

a second lever having a second handle and a second jaw;

a locking assembly including a pivoting lever, a locking pin and a blocking member, wherein the pivoting lever is pivotally coupled to the second lever and the blocking member is coupled to the first lever, wherein the pivoting lever is movable between an unlocked position, wherein the first and second jaw move relative to each other and a locked position, wherein the first and second jaws are fixed relative to each other, wherein in the locked position, the locking pin is wedged against a contact surface of the blocking member precluding relative motion of the blocking member and the pivoting lever; and a barrel rotatably received in a boss defined in the second lever, wherein the locking pin is movably received in a slot defined in the barrel.

2. The hand tool of claim 1 wherein the contact surface is planar along a length of the blocking member and wherein the locking pin is operable to wedge against the contact surface at any location along the contact surface.

3. The hand tool of claim 1 wherein in the locked position, the locking pin wedges between the contact surface of the blocking member and a surface of the slot.

4. The hand tool of claim 1 wherein the barrel defines an aperture that slidably receives the blocking member.

5. The hand tool of claim 4 wherein the aperture extends through a diameter of the barrel.

6. The hand tool of claim 4 wherein the slot extends between an outer diametrical surface of the barrel and the aperture.

7. The hand tool of claim 3 wherein the slot defines a longitudinal axis that is offset from a center of the barrel.

8. The hand tool of claim 1, further comprising a biasing member that biases the pivoting lever toward the unlocked position.

9. The hand tool of claim 1 wherein the pivoting lever includes first and second user engagement portions defined by first and second protruding arms formed thereon.

10. A hand tool for gripping a workpiece comprising:

a first lever associated with a first jaw member;

a second lever associated with a second jaw member, the first and second levers being coupled, such that relative motion of the first and second lever toward each other influences relative motion of the first and second jaw members toward each other; and a locking assembly including an engagement member coupled to the first lever and a third lever rotatably coupled to the second lever, wherein rotation of the third lever wedges the engagement member between a first and second portion of the locking assembly in a locked position and precludes the engagement member from movement relative to the second lever;

wherein the first portion of the locking assembly includes a first wedge surface formed on a barrel received in a boss formed in the second lever.

11. The hand tool of claim 10 wherein the first wedge surface is defined on an aperture formed in the barrel.

12. The hand tool of claim 10 wherein the second portion of the locking assembly comprises a locking pin movably received in a slot defined in the barrel.

13. The hand tool of claim 12 wherein the locking pin engages a surface of the slot and a contact surface of the engagement member in the locked position.

14. The hand tool of claim 13 wherein the engagement member defines an elongated bar.

15. The hand tool of claim 12 wherein the aperture extends through a diameter of the barrel and wherein the engagement member is slidably received by the aperture.

16. The hand tool of claim 15 wherein the slot extends between an outer diametrical surface of the barrel and the aperture.

17. The hand tool of claim 12 wherein the slot defines a longitudinal axis that is offset from a center of the barrel.

18. The hand tool of claim 10, further comprising a biasing member that biases the pivoting lever toward the unlocked position.

19. The hand tool of claim 10 wherein the third lever includes a first and second user engagement portions defined by a first and second extension arms formed thereon.

20. The hand tool for gripping a workpiece comprising:

a pliers portion including a first lever having a first jaw and a second lever having a second jaw; and a locking assembly comprising:

an engagement member coupled to the first lever and defining a first contact surface and a second contract surface; and a pivoting lever assembly comprising a pivoting lever, a barrel, and a locking pin, wherein the pivoting lever defines a first portion that is rotatably coupled to the second lever and a second portion that defines a user engagement surface, the pivoting lever being rotatable between an unlocked position wherein the first and second jaw positions move relative to each other and a locked position, wherein the first and second jaws are fixed from relative movement, wherein the barrel is received in a boss formed in the second lever and defines a slot formed thereon, wherein the locking pin is received in the slot and is movable along the slot between an engaged position and an unengaged position, wherein in the engaged position, the locking pin is wedged between a surface of the slot and the first contact surface of the engagement member and the second contact surface of the engagement member is urged against the barrel wherein the engagement member is precluded from moving relative to the barrel.

21. The hand tool of claim 20 wherein the barrel defines an aperture that receives the engagement member and wherein in the locked position, the engagement member is urged against a surface of the aperture and precluded from traversing along the aperture.

* * * * *